US011160397B2

(12) United States Patent
Zurek

(10) Patent No.: US 11,160,397 B2
(45) Date of Patent: Nov. 2, 2021

(54) ORTHOPEDIC CUSHION

(71) Applicant: Melissa Louise Zurek, Austin, TX (US)

(72) Inventor: Melissa Louise Zurek, Austin, TX (US)

( * ) Notice: Subject to any disclaimer, the term of this patent is extended or adjusted under 35 U.S.C. 154(b) by 0 days.

(21) Appl. No.: 16/856,616

(22) Filed: Apr. 23, 2020

(65) Prior Publication Data

US 2020/0337479 A1 Oct. 29, 2020

Related U.S. Application Data

(60) Provisional application No. 62/837,924, filed on Apr. 24, 2019.

(51) Int. Cl.
*A47G 9/10* (2006.01)
*A47C 16/00* (2006.01)

(52) U.S. Cl.
CPC ..... *A47G 9/10* (2013.01); *A47C 16/00* (2013.01); *A47C 16/005* (2013.01); *A47G 2009/1018* (2013.01); *A47G 2200/00* (2013.01)

(58) Field of Classification Search
CPC ..... A47G 2009/1018; A47G 9/10; A47G 2200/00; A47G 9/1009; A47G 9/109; A47G 9/1063; A47C 20/02; A47C 16/00; A47C 16/005; A47C 20/00; A47C 20/027; A61H 1/0229; A61H 1/0281; A61H 1/0292; A61H 1/0296; A61H 37/00; A63B 21/4037; A63B 21/4039
See application file for complete search history.

(56) References Cited

U.S. PATENT DOCUMENTS 4,987,625 A * 1/1991 Edelson ..... A47C 20/026 5/420
5,479,667 A * 1/1996 Nelson ..... A47G 9/10 5/636
6,902,537 B1 * 6/2005 Geisert ..... A47G 9/1081 602/19
7,020,918 B1 * 4/2006 Tinsley ..... A47C 16/00 5/630
8,298,126 B2 * 10/2012 Berc ..... A63B 21/4037 482/142

* cited by examiner

*Primary Examiner* — David R Hare
*Assistant Examiner* — Madison Emanski
(74) *Attorney, Agent, or Firm* — Philip S. Hof

(57) ABSTRACT

An orthopedic cushion includes a head support segment and a torso support segment. The head support segment has a width between first and second ends thereof. The torso support segment is connected to the head support segment at a middle region of the head support segment halfway between the first and second ends. The torso support segment has a width between first and second lateral edges thereof. The width of the torso support segment is less than the width of the head support segment to define a first well and a second well on either side of the torso support segment adjacent the head support segment. The first well is defined along the first lateral edge, and the second well is defined along the second lateral edge.

18 Claims, 3 Drawing Sheets

ORTHOPEDIC CUSHION

CROSS-REFERENCE TO RELATED APPLICATIONS

This application is a non-provisional conversion of, and claims the benefit of, U.S. Provisional Application 62/837,924, filed on Apr. 24, 2019, which is incorporated by reference herein in its entirety.

BACKGROUND

The subject matter herein relates to cushions, such as body pillows or pads, that provide orthopedic support for users lying on the cushions in various positions.

Sleeping on regular mattresses can cause an increase in pressure and compression of the shoulder complex causing pain and sleep deprivation and/or degradation. Regular mattresses can exacerbate existing pain and injuries by accentuating misalignment and tightness of nerves and other soft tissues. There is a need for improving sleep and alleviating pain that is either caused by or exacerbated by sleeping on regular mattresses.

SUMMARY

In one or more embodiments, an orthopedic cushion is provided that includes a head support segment and a torso support segment. The head support segment has a width between first and second ends thereof. The torso support segment is connected to the head support segment at a middle region of the head support segment halfway between the first and second ends. The torso support segment has a width between first and second lateral edges thereof. The width of the torso support segment is less than the width of the head support segment to define a first well and a second well on either side of the torso support segment adjacent the head support segment. The first well is defined along the first lateral edge, and the second well is defined along the second lateral edge.

In one or more embodiments, an orthopedic cushion is provided that includes a first broad segment, a second broad segment, and a narrow segment disposed between the first and second broad segments along a length of the cushion. The narrow segment interconnects the first and second broad segments. A width of the narrow segment between first and second lateral edges thereof is less than respective widths of the first and second broad segments to define a first well and a second well between the first and second broad segments. The first well is defined along the first lateral edge of the narrow segment, and the second well is defined along the second lateral edge of the narrow segment.

In one or more embodiments, an orthopedic cushion is provided that include a head support segment, a torso support segment, and a cushion cover. The head support segment includes one or more layers of foam and has a width between first and second ends thereof. The torso support segment includes one or more layers of foam. The cushion cover encloses the head support segment and the torso support segment and connects the heat support segment to the torso support segment. The torso support segment extends from a middle region of the head support segment halfway between the first and second ends. The torso support segment has a width between first and second lateral edges thereof. The width of the torso support segment is less than the width of the head support segment to define a first well and a second well on either side of the torso support segment adjacent the head support segment. The first well is defined along the first lateral edge, and the second well defined along the second lateral edge. The first and second wells are open-air voids extending through an entire thickness of the cushion.

DETAILED DESCRIPTION

Embodiments of the inventive subject matter describe an orthopedic cushion that provides postural alignment. The orthopedic cushion is a body cushion that extends a significant length along the height of an individual or user lying on the cushion. For example, the orthopedic cushion has a head support segment that aligns with the head of the user and a torso support segment that aligns with the torso of the user. The orthopedic cushion may also have a leg support segment that aligns with the waist and legs of the user. The torso support segment may align with an upper torso area of the user, and the leg support segment may align with the legs, waist, and optionally also the lower torso area of the user. The orthopedic cushion may have a sufficient thickness and density to support at least some of the weight of the user.

The orthopedic cushion has wells along both lateral edges of the torso support segment below the head support segment. The wells may be recesses, cut-out sections, cavities, openings, or the like. The wells are positioned, sized, and shaped accommodate the shoulders and arms of the user lying on the cushion depending on the resting position of the user. For example, when the user is lying in a first sidelying position, the left shoulder and left arm align with and are received into one of the wells. In this first sidelying position, the torso support segment engages a portion of the back and side of the user, providing postural alignment of the spine. The portions of the cushion surrounding the well support some of the weight of the user, which reduces pressure exerted on the left shoulder and left arm by the mattress (relative to lying directly on the mattress in the sidelying position). Reducing pressure on the shoulder and arm may enhance blood flow to the extremities and alleviate arm and shoulder-related pain, which may enable faster healing of arm and shoulder-related injuries. Furthermore, the orthopedic cushion may provide enhanced comfort that allows the individual to have better sleep (e.g., quicker to fall asleep, greater amount of time in deep sleep, more consistent and less interrupted sleep, etc.) than lying directly on conventional mattresses.

The orthopedic cushion described herein may include or represent one or more cushions, pillows, pads, and/or the like. The orthopedic cushion may be placed on top of a conventional mattress such that the cushion represents an intervening layer between the user and the mattress. Depending on personal preference, the user may utilize other pillows with the orthopedic cushion. For example, the user may place one or more pillows on top of the head support segment of the orthopedic cushion to prop up the user's head. The orthopedic cushion optionally may be used without a conventional mattress. For example, the orthopedic cushion may be placed directly on box springs, bed slats, or another bed support structure. In another example, the cushion may be placed directly on a floor.

Figure 1:
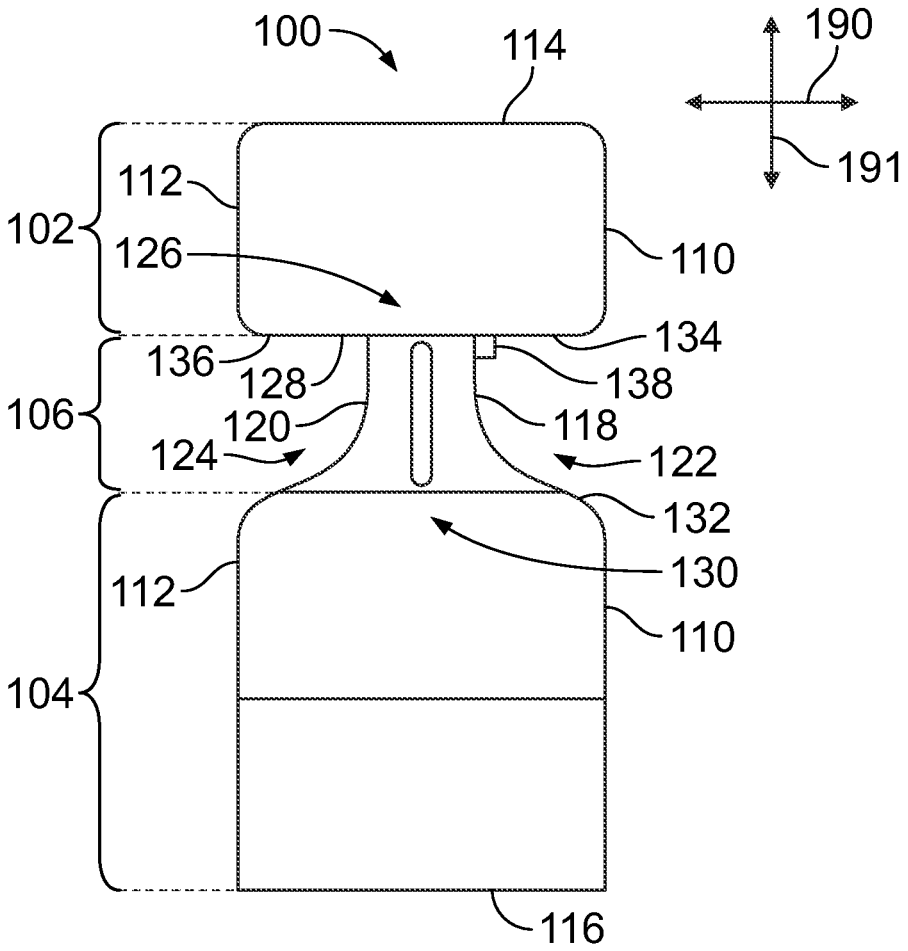
FIG. 1 is a plan view of an orthopedic cushion according to an embodiment.

FIG. 1 is a plan view of an orthopedic cushion 100 according to an embodiment. The plan view in FIG. 1 may be a top-down view of the cushion 100 when the cushion 100 is spread out on a bed, cot, floor, or the like. When disposed in the illustrated shape, the cushion 100 is configured to provide orthopedic support for a person that lies thereon (referred to herein as a user). The cushion 100 includes a first broad segment 102, a second broad segment 104, and a narrow segment 106. The terms "broad" and "narrow" as used herein are relative terms. For example, the first and second broad segments 102, 104 are wider than the narrow segment 106 along a lateral axis 190. The cushion 100 extends an overall width along the lateral axis 190 from a first end 110 to a second end 112 opposite the first end 110. In the illustrated orientation, the first end 110 is a right end and the second end 112 is a left end. The first and second ends 110, 112 are referred to herein as right and left ends 110, 112 for ease of description, but it is recognized that the cushion may be rotated and/or flipped such that the first end 110 is located left of the second end 112.

The cushion extends an overall length along a longitudinal axis 191 from a head end 114 to a foot end 116 that is opposite the head end 114. The longitudinal axis 191 is orthogonal to the lateral axis 190. The narrow segment 106 is disposed between the first broad segment 102 and the second broad segment 104 along the length of the cushion 100. The first and second broad segments 102, 104 are spaced apart from each other along the length. The narrow segment 106 is connected to both the first and second broad segments 102, 104 and interconnects the two broad segments 102, 104. The cushion 100 may generally have an hourglass shape, although in one or more embodiments the cushion is not symmetric about a lateral line that bisects the cushion 100 along the length.

The dimensions of the cushion 100 may be selected to accommodate at least a majority of adults. Optionally, the length may be selected based on known lengths of beds and/or mattresses. For example, the cushion length may be sized to extend at least a majority of the length of a standard queen mattress. Optionally, the length of the cushion 100 may be sized based on the intended users. For example, the length may be at or greater than the height of an adult male that is in the 95% percentile of height (or another selected percentile). The cushion 100 may be scaled to different sized based on different bed/mattress sizes and/or different heights of the intended users. For example, the cushion 100 may have a small size configured for use on a twin bed, a medium size configured to use on a queen-sized bed, and a large size configured to use on a king-sized bed. In another example, the cushion 100 may have a small size intended for use by a person shorter than five feet, a medium size for people between five and six feet tall, and a large size for people taller than six feet. Optionally, the cushion may be scaled such that the width of the cushion varies with the length. For example, a large size cushion may have a greater width than a small size cushion. The width may be selected based on the bed sizes too. For example, the cushion 100 may have a width that is equal to or less than half of the width of a standard double bed, queen bed, or king-size bed to enable two cushions 100 to be disposed side-by-side on the same bed.

The narrow segment 106 extends a respective width (along the lateral axis 190) from a first lateral edge 118 thereof to a second lateral edge 120 thereof, which is opposite the first lateral edge 118. The first lateral edge 118 is also referred to herein as a right edge, and the second lateral edge 120 is also referred to herein as a left edge based on the illustrated orientation. The first broad segment 102 may extend the full width of the cushion from the right end 110 to the left end 112. Optionally, the second broad segment 102 also extends the full width of the cushion. The narrow segment 106 is connected to the first broad segment 102 at a middle region 126 of the first broad segment 102. The middle region 126 is halfway between the left and right ends 110, 112. The narrow segment 106 extends from an interior edge 128 of the first broad segment 102. The interior edge 128 faces towards the second broad segment 104. A first edge segment 134 of the interior edge 128 connects to the first (e.g., right) lateral edge 118 of the narrow segment 106 and extends from the lateral edge 118 to the first (e.g., right) end 110. A second edge segment 136 of the interior edge 128 connects to the second (e.g., left) lateral edge 120 of the narrow segment 106 and extends from the lateral edge 120 to the second (e.g., left) end 112. The narrow segment 106 is connected to a middle region 130 of the second broad segment 104. The narrow segment 106 may connect to and extend from an interior edge 132 of the second broad segment 104 that faces towards the first broad segment 102.

Because the narrow segment 106 is narrower than the broad segments 102, 104, a first well 122 and a second well 124 are defined along opposite sides of the narrow segment 106, respectively, in the space between the first broad segment 102 and the second broad segment 104. The first well 122 is defined by the first lateral edge 118 of the narrow segment 106 and the first edge segment 134 of the first broad segment 102. The second well 124 is defined by the second lateral edge 120 of the narrow segment 106 and the second edge segment 136 of the first broad segment. Optionally, portions of the first and second wells 122, 124 may also be defined by the interior edge 132 of the second broad segment 104. The first well 122 is disposed along the right of the narrow segment 106 in FIG. 1 and is also referred to herein as a right well 122. The second well 124 is disposed along the left of the narrow segment 106 in FIG. 1 and is also referred to herein as a left well 124.

The first broad segment 102 is designed to align with and support the head of the user lying on the cushion 100. The narrow segment 106 aligns with and supports the torso of the user. The second broad segment 104 aligns with and supports the lower half of the user, such as the legs and waist. Optionally, the second broad segment 104 may align with the lower back of the user, and the narrow segment 106 aligns with an upper back and/or neck of the user. For these reasons, the first broad segment 102 is referred to herein as a head support segment, the narrow segment 106 is referred to as a torso support segment, and the second broad segment 104 is referred to as a leg support segment. The wells 122, 124, according to one or more embodiments, align with the arms of the user. For example, when the user is in a sidelying position, the lower shoulder and arm are configured to be received at least partially into a corresponding one of the wells 122, 124. Thus, if the user is facing towards the right end 110 in a sidelying position, the left arm and left shoulder are received into to the right well 122 while other portions of the user's body are supported by the segments 102, 104, 106 of the cushion 100.

In an embodiment, the right and left lateral edges 118, 120 of the torso support segment 106 are curved or rounded from the top surface to the side surfaces and/or bottom surface. The rounded edges may be more comfortable for the user than a sharper, right angle corner considering that portions of the user's body may extend past the edges 118, 120 into the wells 122, 124.

Figure 7:
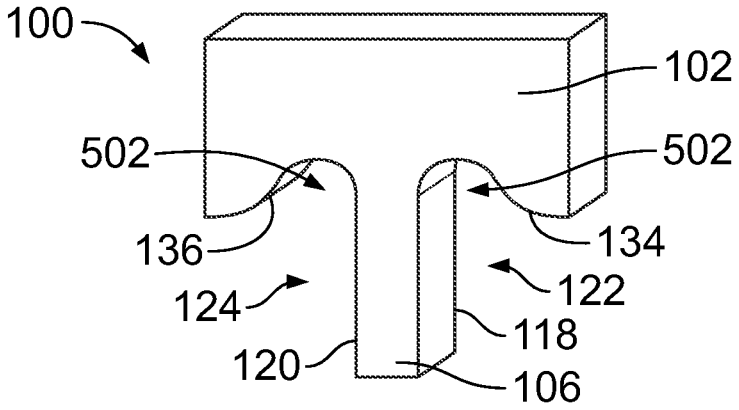
FIG. 7 is a top perspective view of a modified version of the orthopedic cushion shown in FIG. 5.

In the illustrated embodiment, the lateral edges 118, 120 connect to the interior edge 128 of the head support segment 102 at respective right angles. For example, a ninety-degree angle 138 is defined at the interface between the right lateral edge 118 and the right edge segment 134, and another ninety-degree angle is defined at the interface between the left lateral edge 120 and the left edge segment 136. In an alternative embodiment, the intersections between the edges 118, 120 and the interior edge 128 may be curved, such as shown in FIG. 7.

The right and left lateral edges 118, 120 of the torso support segment 106 may be curved along the length such that the torso support segment 106 has a variable width along the length thereof. For example, the lateral edges 118, 120 in the illustrated embodiment curve away from each other with increasing distance from the head support segment 102 such that the width of the torso support segment 106 gradually increases with increasing proximity to the leg support segment 104. As a result, the torso support segment 106 is wider at the connection to the leg support segment 104 than at the connection to the head support segment 102. The lateral edges 118, 120 may each have an "S-shaped" curve. In an embodiment, the cushion 100 is symmetric along a longitudinal line (e.g., parallel to the longitudinal axis 191) that bisects the width of the cushion 100 along the entire length of the cushion 100.

The resulting shape of the wells 122, 124 provides room for the shoulders and arms. The cushion 100 is designed to accommodate a range of sleeping position preferences of the user. For example, depending on the sidelying direction of the user, the lower shoulder may be received into the corresponding well at or near the (right angle) interface between the torso segment 106 and the head segment 102. The wells 122, 124 are shaped to accommodate the arm in a range of permissible arm positions and angles. For example, if the lower arm is extended straight outward, then the arm may be located proximate to the corresponding edge segment 134, 136 of the head support segment 102. If the lower arm is located closer to the trunk (e.g., torso and waist), then the arm may be within the well proximate to the corresponding lateral edge 118, 120 of the torso support segment 106.

In one or more alternative embodiments, the lateral edges 118, 120 may be linear instead of curved or may have a different type of curve than illustrated and described with reference to FIG. 1. Furthermore, the lateral edges 118, 120 optionally may connect to the edge segments of the head support segment 102 at angles other than right angles, such as 80-degree angles, 100-degree angles, or the like.

Figure 2:
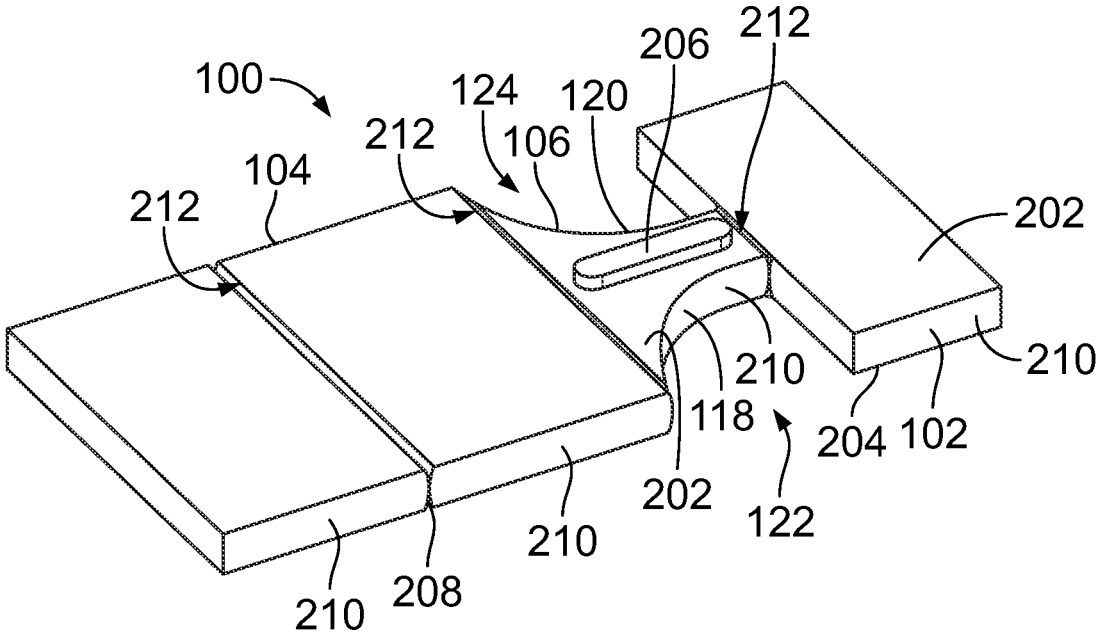
FIG. 2 is a perspective view of the cushion according to an embodiment.

FIG. 2 is a perspective view of the cushion 100 according to an embodiment. The cushion 100 has a first side 202 and a second side 204 that is opposite the first side 202. In the illustrated orientation, the first side 202 is a top side and the second side 204 is a bottom side. The bottom side 204 may engage in physical contact a mattress, a bedframe, a box spring mattress, a floor, a cot, or the like. The top side faces upward, and the user lies on the top side 202. The cushion 100 has a thickness extending from the top side 202 to the bottom side 204. The thickness is oriented along a depth axis that is orthogonal to the longitudinal axis 191 and the lateral axis 190 shown in FIG. 1.

In an embodiment, the thickness of the cushion 100 is not uniform throughout the entire cushion 100. For example, the torso support segment 106 includes a protruding ridge 206 along the top side 202. The ridge 206 is elongated along a centerline of the segment 106. The centerline is halfway between the right and left lateral edges 118, 120. The ridge 206 is elevated above a surrounding area of the torso support segment 106. Due to the ridge 206, the top side 202 of the torso support segment 106 may have a convex curvature along the width such that the centerline of the torso support segment 106 is raised relative to the first and second lateral edges 118, 120. The ridge 206 may provide postural support and improve alignment during sleep. For example, when the user is resting in a sidelying position (facing either direction), the ridge 206 may engage the user's back. The ridge 206 may cradle and support the back. Additionally, when the user is resting in a supine or face-up position on the cushion 100, the ridge 206 may contact the back along the spine, providing additional lift for the chest cavity which improves posture by opening up the shoulders. The ridge 206 may be formed by a discrete foam element coupled to the torso support segment 106 along the top side 202. Alternatively, the ridge 206 may be an integral portion of the foam or other filler material that comprises the torso support segment 106, such that the foam material of the torso support segment 106 is thicker along the ridge 206 than along the areas adjacent to the ridge 206.

In an alternative embodiment, the cushion 100 can have a generally uniform thickness throughout. For example, the torso support segment 106 may lack the ridge 206 and have a planar top side 202. Relative to the underlying surface below the cushion 100, the torso support segment 106 itself may function like a ridge to lift the user's back along the spine, improving posture by opening up the shoulders when lying in the supine position. Regardless of whether or not the ridge 206 is present, the head support segment 102 and the leg support segment 104 may have uniform thicknesses with planar top and bottom surfaces or faces. The planar top surface of the head support segment 102 easily supports placement of one or more pillows thereon. The width of the head support segment 102 may be equal to or greater than the length of a standard head pillow for sleeping.

The cushion 100 includes a compressible filler material that is suitable to support at least some of the weight of the user and provides other application-specific characteristics. The filler material may include or represent polyester batting, polyester fiberfill, foam, padding, or the like. Suitable types of foam may include medium density polyurethane antimicrobial foam, high density polyurethane foam, open cell foam, closed cell foam, memory foam, or the like. Each of the segments 102, 104, 106 of the cushion 100 may include one or more layers of foam. Optionally, a layer of foam may have an egg crate shape. The filler material may be surrounded by a cushion cover 208, such as a fitted sheet, which encloses the layers of foam along each of the segments 102, 104, 106. The cover 208 may be removable for washing. In an embodiment, the different segments 102, 104, 106 are formed from different panels 210 of foam. Each panel 210 is a stack of one or more layers of foam. In the illustrated embodiment, the head support segment 102 and the torso support segment 106 are each defined by a single respective panel 210, and the leg support segment 104 is defined by two panels 210. The panels 210 of foam are connected to each other at joints 212. The joints 212 may be straps or the like that allow the panels 210 to fold at the joints 212 while retaining the connection between the panels 210. The foldable joints 212 may be portions of the cover 208. The cushion 100 folds up for storage. In an embodiment, the cover 208 has a reclosable opening that enables modifying the thickness of the segments 102, 104, 106 by selectively adding layers of foam or removing layers of foam according to personal preferences.

In an alternative embodiment, the entire cushion 100 may be defined by a unitary, monolithic panel of one or more foam layers, such that the cushion 100 lacks joints and seams between the segments 102, 104, 106. In this alternative embodiment, the cushion 100 can roll up for storage.

In the illustrated embodiment, the left and right wells 122, 124 of the cushion 100 are open-air voids or cut-out regions. The wells 122, 124 extend through the entire thickness of the cushion 100. In an alternative embodiment, the wells 122, 124 are cavities or depressions that are recessed relative to the top side 202, but the wells 122, 124 do not extend through the entire thickness of the cushion 100. For example, the cushion 100 may have a thin web or flap of material, such as a segment of the cover 208 along the bottom side 204 in the area of each of the wells 122, 124. Such a thin layer of material would be configured to enable the wells 122, 124 to function in the same way as described above for accommodating the user's shoulder and arms.

Optionally, the cushion 100 may include removable wing segments that are sized and shaped to correspond to the wells 122, 124. For example, the wing segments are configured to essentially fill the voids defined by the wells 122, 124 when the wing segments are in place. The wing segments may be foam pillows that are contoured to match the contours of the wells 122, 124. The thickness and material of the wing segments may be the same or similar to the thickness and/or material of the torso support segment 106. When the wing segments are in place with the wells 122, 124 such that each well 122, 124 is occupied by a different wing segment, the cushion 100 may have a rectangular shape with four linear edges. The wing segments may be held in place due to fasteners, such as Velcro™, zippers, snaps, or the like, or an interference fit between the head support segment 102 and the leg support segment 104. With the wing segments in place, the cushion 100 may resemble a traditional mattress pad or full body pillow. The wing segments are selectively removable to provide the shape of the cushion 100 shown in FIG. 1. With the wing segments removed, the cushion 100 provides the postural alignment benefits described herein.

Figure 3:
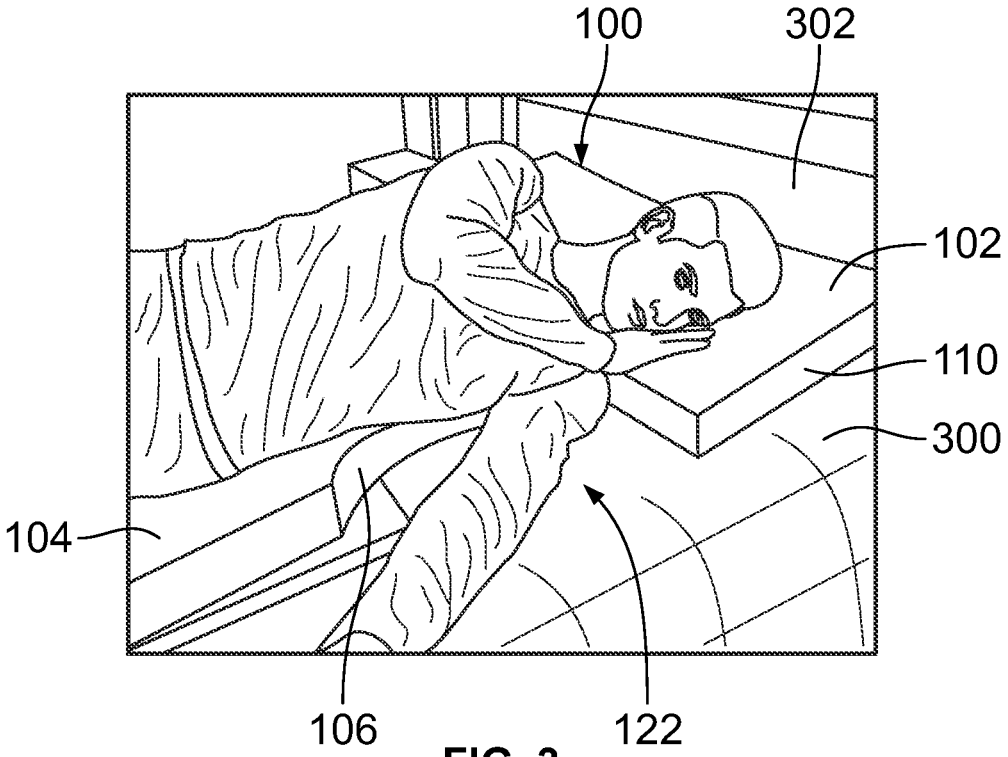
FIG. 3 illustrates an example application of the cushion showing a user resting on the cushion in a sidelying position.

FIG. 3 illustrates an example application of the cushion 100 showing a user resting on the cushion 100 in a sidelying position. The cushion 100 is disposed on top of a mattress 300 of a bed 302 in the illustrated application. The user is leftward-facing, such that the user faces towards the right end 110 of the cushion 100. The user's head is resting directly on the head support segment 102. The torso support segment 106 is under the torso, or more specifically the upper torso and chest area, of the user. The leg support segment 104 is under the waist and legs of the user. In this sidelying position, the left arm and shoulder are received into the right well 122. The left shoulder is at or proximate to the intersection between the torso support segment 106 and the head support segment 102. Due to the size of the well 122, the user can freely move the left arm within a large range of permissible angles while remaining within the well 122. The support provided by the torso segment 106 on the back of the user significantly reduces the weight and pressure that would otherwise be applied on the left shoulder and arm, which may alleviate pain, enable timely healing of injuries, improve sleep quality, improve posture, and/or the like. If the user rolls over and sleeps in the opposite rightward-facing sidelying position, then the right shoulder and right arm are received into the left well 124 while the back remains supported by the torso support segment 106.

Figure 4:
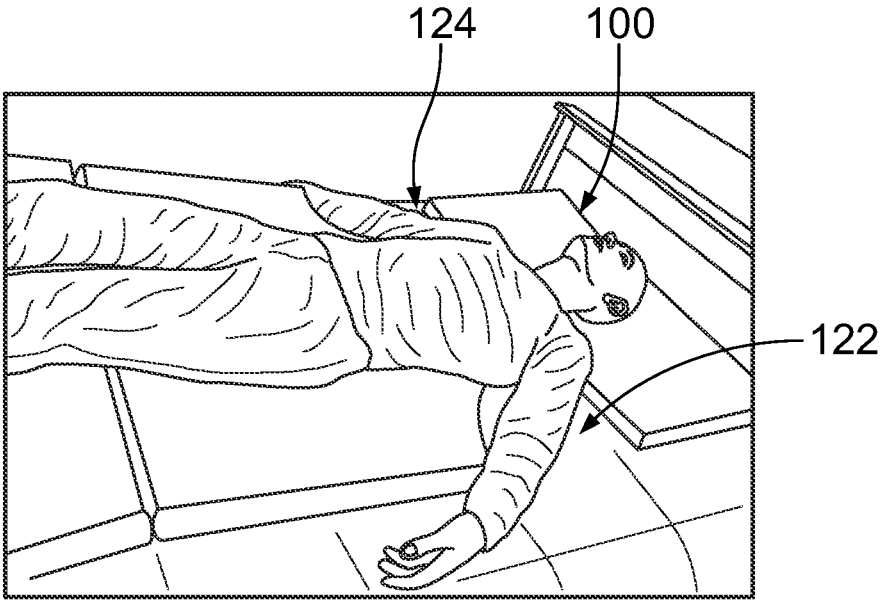
FIG. 4 illustrates an example application of the cushion showing a user resting on the cushion in a supine position.

FIG. 4 illustrates an example application of the cushion 100 showing a user resting on the cushion 100 in a supine position. In the supine position, the user is facing upward away from the cushion 100. The user aligns with the portions of the cushion 100 as described above in FIG. 3. In the supine position, each of the right and left wells 122, 124 accommodate a different corresponding arm of the user. For example, the left arm is received in the right well 122, and the right arm is received in the left well 124. The torso support segment underneath the upper back lifts the chest and spine, which opens up the shoulders. In this position, the user may alleviate pain, enable timely healing of injuries, improve sleep quality, improve posture, and/or the like. Furthermore, the lifted chest cavity may provide improved respiration during sleep.

The cushion 100 may also accommodate the user lying in a prone or face-down position. When prone, the torso support segment engages and supports the chest and allows the arms to lower into the corresponding wells such that the left arm is received in the left well 124 and the right arm into the right well 122.

Figure 5:
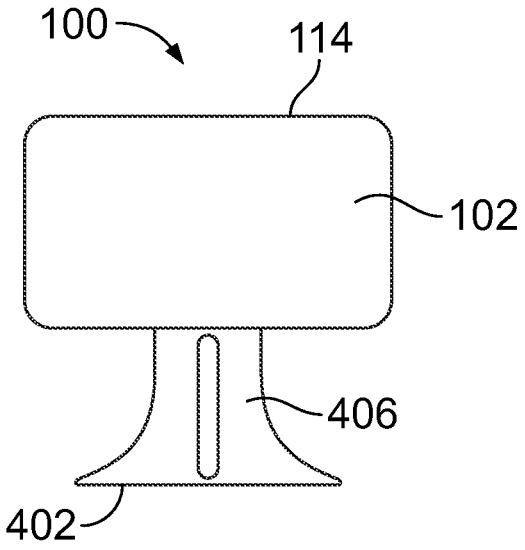
FIG. 5 is a plan view of an orthopedic cushion according to another embodiment.
Figure 6:
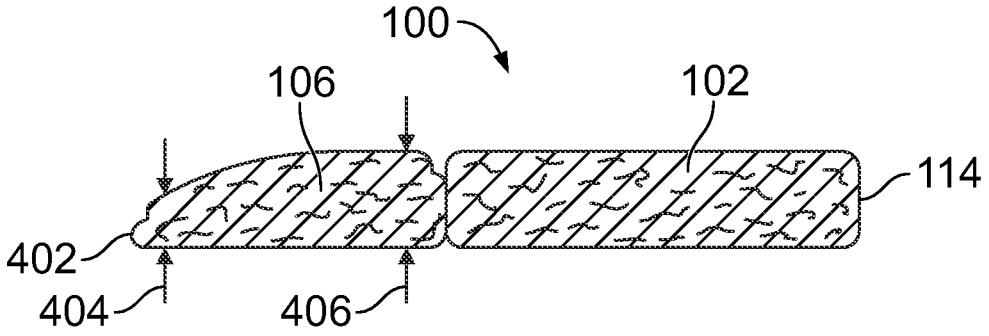
FIG. 6 is a side view of the orthopedic cushion shown in FIG. 5.

FIG. 5 is a plan view of an orthopedic cushion 100 according to another embodiment. FIG. 6 is a side view of the cushion 100 shown in FIG. 5. The cushion 100 in the illustrated embodiment includes the broad, head support segment 102 and the narrow, torso support segment 106 as shown in FIG. 1, but lacks the broad, leg support segment 104. For example, the length of the cushion extends from the head end 114 to a distal end 402 of the torso support segment 106. Optionally, the torso support segment 106 tapers in thickness. For example, the thickness 404 of the torso support segment 106 at the distal end 402 is less than the thickness 406 of the torso support segment 106 closer to the heat support segment 102. The tapering may provide comfort and a smooth transition from the upper body of the user that is supported by the cushion 100 and the lower body of the user that is off the cushion 100.

FIG. 7 is perspective view of a modified version of the orthopedic cushion 100 shown in FIG. 5. In FIG. 7, the intersections between the lateral edges 118, 120 of the torso support segment 106 and edge segment 134, 136 of the head support segment 102 are curved. The edge segments 134, 136 form S-curves that define respective recesses 502. The recesses 502 are disposed along the edges of the respective first and second wells 122, 124, such that the recesses are essentially outcrop portions of the wells. The recesses 502 may be sized and shaped to accommodate the shoulders of the user that is side-facing in either direction. The recesses 502 may be particularly useful for taller users whose shoulders can nest within the recesses 502 instead of potentially rubbing against the edge segments 134, 136.

The above description is illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments and are merely example embodiments. Other embodiments and modifications may be apparent to those of ordinary skill in the art upon reviewing the above description. As used herein, the terms "including" and "in which" are used as the plain-English equivalents of the respective terms "comprising" and "wherein." Moreover, terms such as "first," "second," "third," "upper," "lower," "bottom," "top," etc. are used merely as labels, and are not intended to impose numerical or positional requirements on their objects.

What is claimed is:

1. An orthopedic cushion comprising:

a head support segment having a width between first and second ends thereof; and a torso support segment connected to the head support segment at a middle region of the head support segment halfway between the first and second ends, the torso support segment having a width between first and second lateral edges thereof, wherein the width of the torso support segment is less than the width of the head support segment to define a first well and a second well on either side of the torso support segment adjacent the head support segment, wherein the head support segment includes a first edge segment extending from the first end to the first lateral edge of the torso support segment and a second edge segment extending from the second end to the second lateral edge of the torso support segment, the first well at least partially defined by the first lateral edge and the first edge segment, and the second well at least partially defined by the second lateral edge and the second edge segment, wherein the first edge segment of the head support segment forms an S-curve from the first end to the first lateral edge of the torso support segment and meets the first lateral edge at a first curved intersection, the first curved intersection defining an outcrop portion of the first well, and wherein the second edge segment of the head support segment forms an S-curve from the second end to the second lateral edge of the torso support segment and meets the second lateral edge at a second curved intersection, the second curved intersection defining an outcrop portion of the second well.

2. The orthopedic cushion of claim 1, wherein the first well is configured to accommodate a left shoulder and left arm of a user lying in a first sidelying position, and the second well is configured to accommodate a right shoulder and right arm of the user lying in an opposite, second sidelying position.

3. The orthopedic cushion of claim 1, wherein the first and second wells are configured to accommodate different corresponding arms of the user when the user is lying in a supine position or a prone position.

4. The orthopedic cushion of claim 1, wherein a top side of the torso support segment includes an elevated ridge that is elongated along a centerline of the torso support segment halfway between the first and second lateral edges.

5. The orthopedic cushion of claim 1, wherein the first and second wells represent open-air voids extending through an entire thickness of the cushion.

6. The orthopedic cushion of claim 1, wherein a thickness of the torso support segment tapers with increasing distance from the head support segment.

7. The orthopedic cushion of claim 1, wherein the first and second lateral edges of the torso support segment curve away from each other with increasing distance from the head support segment.

8. The orthopedic cushion of claim 1, further comprising a leg support segment connected to the torso support segment such that the torso support segment is disposed between the head support segment and the leg support segment along a length of the cushion, the leg support segment having a greater width than the torso support segment.

9. The orthopedic cushion of claim 1, wherein the head support segment and the torso support segment include one or more layers of foam contained within a cushion cover.

10. The orthopedic cushion of claim 9, wherein the cushion cover is sized to accommodate multiple layers of foam and has a reclosable opening to enable adding or removing one or more of the layers.

11. The orthopedic cushion of claim 9, wherein the one or more layers of foam of the torso support segment are separated from the one or more layers of foam of the head support segment by a foldable joint that is provided by the cushion cover.

12. The orthopedic cushion of claim 1, wherein the torso support segment is connected to the head support segment at a foldable joint.

13. An orthopedic cushion comprising: a first broad segment comprising a first foam panel; a second broad segment comprising a second foam panel; and a narrow segment comprising a third foam panel and disposed between the first and second broad segments along a length of the cushion, the narrow segment interconnecting the first and second broad segments, wherein a width of the narrow segment between first and second lateral edges thereof is less than respective widths of the first and second broad segments to define a first well and a second well between the first and second broad segments, wherein the first broad segment is configured to align with a head of a user ling on the cushion and the narrow segment is configured to align with a torso of the user lying on the cushion, each of the first and second wells configured to accommodate a corresponding shoulder and an arm of the user, the first well defined along the first lateral edge of the narrow segment and the second well defined along the second lateral edge of the narrow segment, wherein the first, second, and third foam panels are discrete from one another and each of the first, second, and third foam panels comprises one or more layers of foam, wherein the narrow segment is connected to the first broad segment at a first foldable joint and the narrow segment is connected to the second broad segment at a second foldable joint, wherein a thickness of the narrow segment tapers with increasing distance from the first broad segment and increasing proximity to the second broad segment.

14. The orthopedic cushion of claim 13, wherein a top side of the narrow segment includes an elevated ridge that is elongated along a centerline of the narrow segment halfway between the first and second lateral edges.

15. The orthopedic cushion of claim 13, wherein the first and second wells represent open-air voids extending through an entire thickness of the cushion.

16. The orthopedic cushion of claim 13, further comprising a cushion cover that encloses the first foam panel, the second foam panel, and the third foam panel, the cushion cover including a reclosable opening to enable adding or removing foam from at least one of the first broad segment, the narrow segment, or the second broad segment, wherein the first foldable joint and the second foldable joint are portions of the cushion cover.

17. The orthopedic cushion of claim 13, wherein the first broad segment includes a first edge segment extending from the first end to the first lateral edge of the narrow segment and a second edge segment extending from the second end to the second lateral edge of the narrow segment, wherein the first edge segment of the first broad segment forms an S-curve from the first end to the first lateral edge of the narrow segment and meets the first lateral edge at a first curved intersection, the first curved intersection defining an outcrop portion of the first well, and wherein the second edge segment of the first broad segment forms an S-curve from the second end to the second lateral edge of the narrow segment and meets the second lateral edge at a second curved intersection, the second curved intersection defining an outcrop portion of the second well.

18. An orthopedic cushion comprising:

a head foam panel comprising one or more layers of foam and configured to support a head of a user, the head foam panel having a width between first and second ends thereof;

a torso foam panel comprising one or more layers of foam and configured to support a torso of the user, the torso foam panel discrete from the head foam panel; and a cushion cover that encloses the head foam panel and the torso foam panel, wherein the cushion cover defines a foldable joint between the head foam panel and the torso foam panel which connects the head foam panel to the torso foam panel, wherein the torso foam panel extends from a middle region of the head foam panel halfway between the first and second ends, the torso foam panel having a width between first and second lateral edges thereof, wherein the width of the torso foam panel is less than the width of the head foam panel to define a first well and a second well on either side of the torso foam panel adjacent the head foam panel, the first well defined along the first lateral edge and the second well defined along the second lateral edge, wherein the first and second wells are open-air voids extending through an entire thickness of the cushion.

* * * * *